US006978949B2

(12) United States Patent
Dallmeyer

(10) Patent No.: US 6,978,949 B2
(45) Date of Patent: Dec. 27, 2005

(54) APPARATUS AND METHOD FOR SETTING INJECTOR LIFT

(75) Inventor: Michael P. Dallmeyer, Newport News, VA (US)

(73) Assignee: Siemens VDO Automotive Corporation, Auburn Hills, MI (US)

( * ) Notice: Subject to any disclaimer, the term of this patent is extended or adjusted under 35 U.S.C. 154(b) by 20 days.

(21) Appl. No.: 10/645,589

(22) Filed: Aug. 22, 2003

(65) Prior Publication Data

US 2004/0056121 A1 Mar. 25, 2004

Related U.S. Application Data

(62) Division of application No. 09/878,995, filed on Jun. 13, 2001, now Pat. No. 6,648,249.

(60) Provisional application No. 60/223,981, filed on Aug. 9, 2000.

(51) Int. Cl.[7] ..... F02M 39/00; F02M 59/00; F02M 61/00; B05B 1/30

(52) U.S. Cl. ..... 239/533.3; 239/533.2; 239/533.11; 239/533.14; 239/585.1; 239/585.5; 239/585.4

(58) Field of Search ..... 239/533.3, 533.2, 239/533.9, 533.11, 533.14, 585.1, 585.3, 239/585.4, 585.5, 88–93; 251/127, 129.15, 251/129.21; 29/890, 124, 127

(56) References Cited

U.S. PATENT DOCUMENTS

| | | | | |
|---|---|---|---|---|
| 3,241,768 | A | 3/1966 | Croft | |
| 3,773,265 | A | 11/1973 | Kent | 239/585 |
| 4,471,914 | A | 9/1984 | Hafner et al. | 239/585 |
| 4,771,984 | A | 9/1988 | Szablewski et al. | 251/129.15 |
| 4,951,878 | A | 8/1990 | Casey et al. | 239/462 |
| 5,192,048 | A | 3/1993 | Wakeman | 251/129.16 |
| 5,199,648 | A | 4/1993 | Fujikawa | 239/585.4 |
| 5,263,648 | A | 11/1993 | Vogt et al. | 239/585.4 |
| 5,307,991 | A | 5/1994 | Hanson et al. | 239/1 |
| 5,462,231 | A | 10/1995 | Hall | 239/585.4 |
| 5,713,523 | A | 2/1998 | Fujikawa | 239/585.1 |
| 5,755,386 | A | 5/1998 | Lavan et al. | 239/585.4 |
| 5,775,600 | A | 7/1998 | Wideson et al. | 239/585.4 |
| 5,937,887 | A | 8/1999 | Baxter et al. | 137/15 |
| 6,065,692 | A | 5/2000 | Brinn, Jr. | 239/533.12 |
| 6,076,802 | A | 6/2000 | Maier | 251/129.21 |
| 6,142,395 | A | 11/2000 | Reiter | 239/585.1 |
| 6,186,421 | B1 | 2/2001 | Wahba et al. | 239/585.1 |
| 6,244,525 | B1 | 6/2001 | Gallup et al. | 239/533.12 |
| 6,648,249 | B1 * | 11/2003 | Dallmeyer | 239/585.1 |

* cited by examiner

*Primary Examiner*—Davis Hwu

(57) ABSTRACT

A method of directly setting an injector lift that involves the provisioning of a valve body having an uniform internal diameter, inserting a sleeve assembly to a predetermined distance and securing the sleeve assembly. The apparatus includes a sleeve, a lower armature guide and a seat, all of which can be integral so as to facilitate the setting of the injector lift. The sleeve assembly is press-fitted and secured by known attachment techniques.

6 Claims, 1 Drawing Sheet

APPARATUS AND METHOD FOR SETTING INJECTOR LIFT

This divisional application claims the benefit under 35 U.S.C. §§ 120 and 121 of original application Ser. No. 09/878,995 filed on Jun. 13, 2001, now U.S. Pat. No. 6,648,249 which claims the benefit of provisional application 60/223,981 filed 9 Aug. 2000, which is hereby incorporated by reference in their entirety into this divisional application.

BACKGROUND OF THE INVENTION

Examples of known fuel injector use an armature assembly having an armature that reciprocates between an open position and a closed position. The distance that the armature travels is known as an injector lift height, working air gap or distance. The working air gap or distance is one of many variables that determine the amount of fuel that will be dispensed outside the fuel injector when the injector is actuated.

The air gap is believed to be set by first taking a series of direct contact measurements. One direct measurement is believed to determine the distance between a contact face of a pole piece of the armature assembly and a sealing diameter of a seat. Another direct measurement is believed to determine the distance between the sealing diameter of a seat and the position of a closure member during a full open position. The difference between these two measurements determines the approximate working gap. The actual working gap is believed to be set by using a deformable ring that is inserted into a shoulder formed at one end of a valve body. The ring is subsequently crushed to the approximate working gap.

The actual working gap, however, may vary between individual injectors due to variations in the direct measurement operations, the deformability of the crush ring material or the valve body. Moreover, the direct measurements oftentimes can introduce contaminants into the fuel injector, leading to the possibility of inconsistent injector performance. Additionally, the crushing operation is believed to introduce undesirable structural loading on the body of the injector. Furthermore, the use of crush ring is believed to require random samplings of the crush ring and injectors to maintain consistent injector performance. Finally, once the crush ring is installed or crushed, it is believed that no adjustment can be made unless the crush ring is extracted and replaced with a new one.

SUMMARY OF THE INVENTION

The present invention provides a fuel injector for use with an internal combustion engine. The fuel injector comprises a housing having a flow passage extending along a longitudinal axis between a first end and a second end; an electromagnetic actuator including a stator having an end face; an armature assembly proximate the electromagnetic actuator, the armature assembly having a surface in confronting arrangement with the end face; spring means to establish a gap between the end face and the surface; a flow metering device disposed within the flow passage proximate the second end, the flow metering device engaging the armature assembly; and a sleeve disposed along the longitudinal axis within the flow passage at a preset position, the sleeve bearing against the flow metering device to define the gap.

The present invention further provides a method of setting a working gap of an armature assembly in a fuel injector.

The fuel injector includes a housing including a first end and a second end extending between a longitudinal axis, a housing having a flow passage extending between the first and second ends, an electromagnetic actuator including a stator and an armature assembly, a spring disposed between the stator and the armature assembly and operable to push the armature assembly towards the second end to form a gap therein. The method comprises inserting a sleeve and a flow metering assembly within the flow passage, the flow metering assembly limiting the movement of the armature assembly towards the second end, and limiting the inserting of the flow metering assembly along the longitudinal axis toward a first end by a position of the sleeve, the position defining the magnitude of the gap between the stator and the armature assembly.

BRIEF DESCRIPTION OF THE DRAWINGS

The accompanying drawing, which is incorporated herein and constitutes part of this specification, illustrates an embodiment of the invention, and, together with the general description given above and the detailed description given below, serve to explain features of the invention.

DETAILED DESCRIPTION OF THE PREFERRED EMBODIMENT

Figure 1:
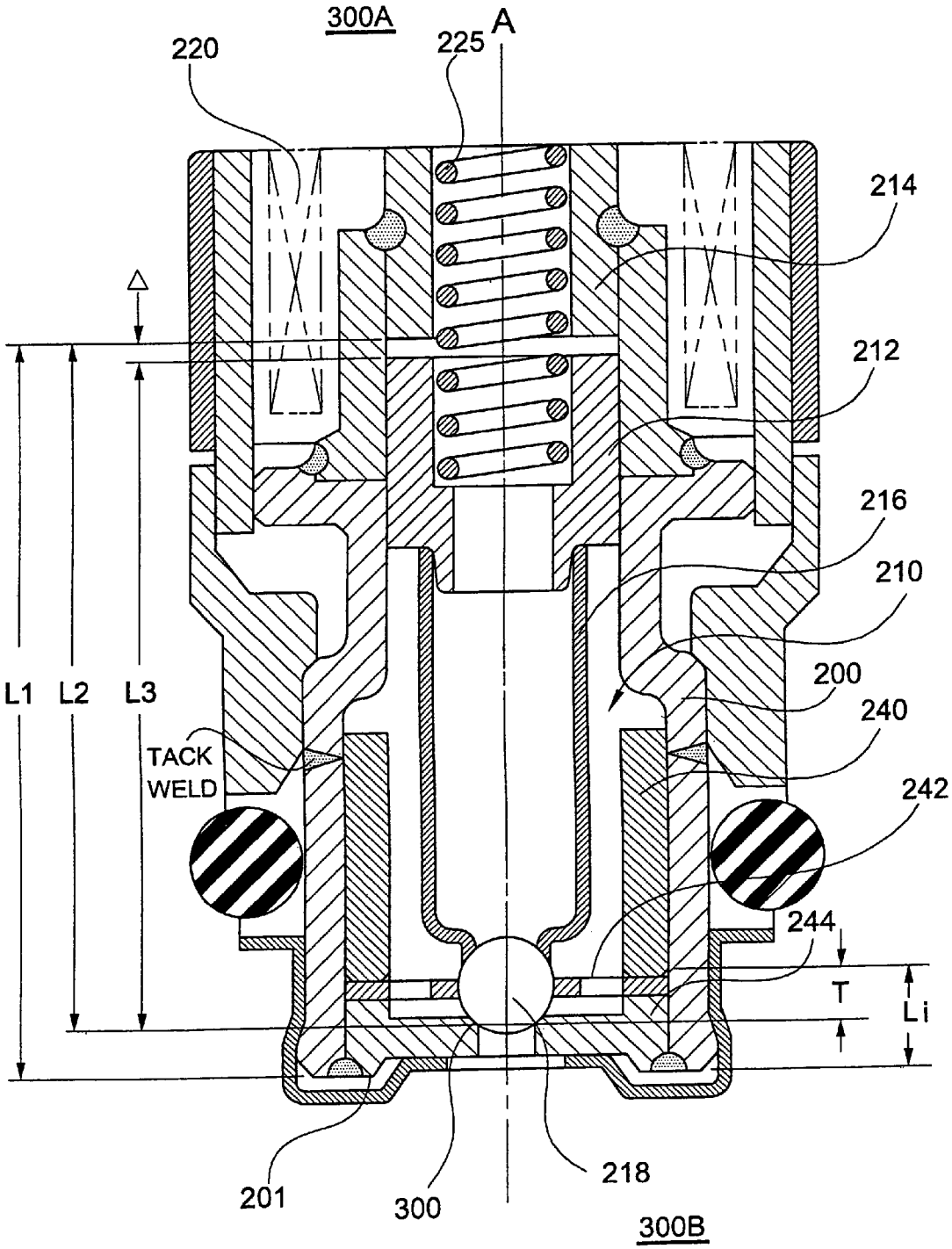
FIG. 1 is a cross-sectional view of the sleeve arrangement in a fuel injector.

Referring to FIG. 1, an enlarged partial view of a fuel injector extending between axis A—A, having a housing or valve body 200, an armature assembly 210 and a ferromagnetic coil 220 disposed between inlet end 300A and outlet end 300B. The armature assembly 210 can include an armature 212, armature tube 216 and a closure element 218. The armature tube 216 can be integrated with the armature 212 for a two-piece armature assembly. Alternatively, the armature tube 216 can be integrated with the closure 218. The armature assembly 210 is magnetically coupled to the electromagnetic actuator assembly 220 that includes a pole piece or a stator 214, coil 220 and bobbin 224. The valve body 200 is affixed to a shell 350 that is further affixed to the pole piece 214. An elastic member 225 that can be a coil spring is disposed between the movable armature 214 and the fixed stator 214. The elastic member 225 operates to bias the armature assembly 210 towards the outlet end 300B of the injector, thereby forming a gap Δ between the stator 214 and the armature 212. Although disclosed as a single spring, the elastic member 225 can include more than one coil spring for a multi-spring rate elastic member. A flow metering device or seat 244 at the outlet end 300B of the injector engages the armature assembly 210, and prevents the elastic member 225 from pushing the armature assembly 210 out of the valve body 200. Where the seat 244 is located defines how far the elastic member 225 can separate the armature assembly 210 from the stator 214. In other words, the elastic member 225 and seat 244 cooperate to define a working gap Δ between the armature 212 and the stator 214. Finally, the location of the seat 244 also sets a spring preload on elastic member 225 that acts on the armature assembly 210 by the elastic member 225.

When the ferromagnetic coil assembly 220 is energized, magnetic flux is generated in the coil 220, which flows to the armature assembly 210 to complete a magnetic circuit between the coil 220 and the armature assembly 210. This causes the armature assembly 210 to move axially towards the stator 214, against the biasing force of the elastic member 225 to close the working gap Δ. The working gap Δ, also known as an injector lift height, determines the volume of fuel to be dispensed when the injector is energized. The greater the working gap Δ, the greater the volume of fuel that can be dispensed. Thus, adjusting the working gap will also adjust the volume of fuel dispensed.

If the working gap Δ is too large, however, it is believed that the magnetic flux generated in the coil 220 may not be sufficient to allow the armature 212 to move against the elastic member 225, thereby resulting in little or no fuel dispensed. If the working gap is too small, however, it is believed that the armature 212 will see a much stronger magnetic flux, causing the armature 212 to bounce off the stator 214 causing, it is believed, uneven fuel atomization or even droplets formation in an intake manifold. Thus, injector performance is believed to be highly dependent on the correct working gap.

To initiate the process of setting the working gap Δ, a sleeve 240 is inserted in the valve body 200 to a predetermined distance Li. By virtue of the sleeve's outside diameter being substantially the same as the inside diameter of the valve body 200, a "working" fit can be made between the sleeve 240 and the valve body 200. "Working fit", as used here, can include a locational clearance fit, a locational interference fit or a transitional fit. Next, the lower armature guide 242 and the seat 244 are then inserted in the valve body 200 until one of the armature guide 242 or the seat abuts the sleeve 240.

To facilitate the insertion in the valve body 200, the valve body 200 is provided with a generally uniform internal diameter for a major portion of its length. Alternatively, the valve body 200 can also be provided with an uniform internal diameter that extends the whole length of the valve body 200. The valve body 200 itself can also be a polygonal tube that will, of course, correspondingly require matching polygonal-shaped sleeve 240, armature guide 242 and seat 244.

The sleeve 240 can be further secured to the valve body 200 by any one of a number of techniques including bonding, welding, tack welding and preferably laser welds. The seat 244 can be affixed by one of a number of techniques noted above. Preferably, the seat 244 can be hermetically welded to the valve body 200.

The sleeve 240 is an annulus having an outside diameter substantially equal to the internal diameter of the valve body 200. The length of the sleeve 240 along the longitudinal axis can be at least twice the internal diameter of the valve body 200. The annular thickness of the sleeve is preferably between 75% and 100% of the thickness of the valve body 200. Alternatively, the thickness of the sleeve 240 can be between 5%–25% of the inside diameter of the valve body 200. The sleeve 240 can be formed by a stamped, a casting, deep drawn or it can be formed by machining a blank. Finally, the sleeve 240 can be made of a nonmagnetic material, which is believed to reduce magnetic flux leakage from the armature assembly.

The armature guide 242 and seat 244 can be integrated together into a single unit. This is believed to reduce the number of steps involved in loading the seat 244 and armature guide 242 in the valve body 200 during manufacturing of a fuel injector. Specifically, the integrated unit is of such dimensions that when the unit is inserted in the valve body 200, the desired lift height is achieved when the seat 244 is flush with the end face 201 of the valve body 200.

Referring again to FIG. 1, the injector's working gap Δ is determined as a function of the difference between distance L2 and distance L3 with one of the datum being the sealing diameter 300 of the seat 244. To ensure that the working gap Δ is correctly set, a tool that is similar to a bearing driver can insert the sleeve 240. Such a tool would have a preset insertion depth Li. The distance Li at which the sleeve 240 can be inserted is determined by the sum of the thickness "T" (defined as the thickness of the seat and the armature guide 242 as measured from the sealing diameter 300 to the surface abutting the sleeve 240) and the distance L1 (as measured between the end face 214*a* of pole piece and the end face 201 of the valve body 200) minus the distance L2 (as measured between the end face of the pole piece 214*a* and the sealing diameter 300).

In particular, to set the injector working gap or height, a valve body 200 is provided in a fuel injector. The valve body 200 has a substantially uniform internal diameter extending along the longitudinal axis A—A. An armature assembly 210 including an armature 212, an armature tube 216 and a closure member 218 is inserted in the valve body 200. The sleeve 240 is then inserted to a predetermined depth Li from the end face 201 of the valve body 200. The lower armature guide 242 and the seat 244 are then inserted. The sleeve 240 is then affixed by known attachment techniques including laser welding, bonding or tack welding. The seat 244 can also be affixed in any one of the known techniques for attaching materials. Alternatively, if the sleeve 240, the guide 242 and the seat 244 are integrated as a one-piece assembly, the assembly, i.e. the lift assembly, can be inserted in a single operation until the seat 244 is flush with the end face 201 of the valve body 200.

As can be seen above, one of the advantages of the preferred embodiment is that the working gap Δ can be changed by simply moving the sleeve 240. This is done by calculating the insertion depth Li based on known values of L1, L2 and T. Once a new insertion depth Li is calculated, the sleeve 240 can be quickly adjusted by moving the sleeve 240 axially along the longitudinal axis A—A of the injector to the desired depth Li.

Additionally, the sleeve 240 is not limited to any one type of fuel injector but can also be used with a modular type fuel injector. Similar to the fuel injector of FIG. 1, the sleeve 240 can be inserted into the modular valve body to a predetermined depth while the guide 242 and the seat 244 are also loaded into the injector.

Several benefits are believed to be achieved by the use of the sleeve 240. Costs associated with the manufacturing of the fuel injector is believed to be reduced because a shoulder for crushing the ring is no longer required to be formed on the valve body 200. In particular, the sleeve 240 is believed to reduce the number of manufacturing operations by virtually eliminating direct contact measurements to ensure a correct lift height. Furthermore, an accurately dimensioned boss portion on the valve body 200 to ensure sufficient crushing of the crush ring is believed to be redundant and no longer required. Additionally, by using an integral unit of the sleeve, guide 242 and seat 244, setting the lift height can be a one step operation. Finally, the use of the sleeve 240 is believed to maintain consistent working gap between individual injectors.

While the present invention has been disclosed with reference to certain embodiments, numerous modifications, alterations, and changes to the described embodiments are possible without departing from the sphere and scope of the present invention, as defined in the appended claims. Accordingly, it is intended that the present invention not be limited to the described embodiments, but that it have the fill scope defined by the language of the following claims, and equivalents thereof.

What is claimed is:

1. A method of setting a working gap of an armature assembly in a injector, the fuel injector having a housing including a first end and a second end extending between a longitudinal axis, a housing having a flow passage extending between the first and second ends, an electromagnetic actuator including a stator and an armature assembly, a spring disposed between the stator and the armature assembly and operable to push the armature assembly towards the second end to form a gap therein, the method comprising:

inserting a sleeve and a flow metering assembly within the flow passage, the flow metering assembly limiting the movement of the armature assembly towards the second end; and limiting the inserting of the flow metering assembly along the longitudinal axis toward a first end by a position of the sleeve, the position defining the magnitude of the gap between the stator and the armature assembly.

2. The method according to claim 1, wherein the housing further comprises a tube.

3. The method according to claim 1, wherein the flow metering assembly includes at least one of a seat, an armature guide and an orifice disk.

4. The method according to claim 1, wherein the sleeve has an outside diameter that grips the inside diameter of the flow passage.

5. The method according to claim 1, wherein the limiting further comprises a sleeve in contiguous engagement with the flow metering assembly.

6. The method according to claim 1, further comprising:

adjusting a volume of fuel dispensed by the fuel injector by moving at least one of the sleeve and seat along the longitudinal axis.

* * * * *